US012330264B2

(12) United States Patent
Chen

(10) Patent No.: US 12,330,264 B2
(45) Date of Patent: Jun. 17, 2025

(54) GRINDING MACHINE TOOL WITH GRINDING DISC BRAKING STRUCTURE

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 651 days.

(21) Appl. No.: 17/682,565

(22) Filed: Feb. 28, 2022

(65) Prior Publication Data

US 2023/0271295 A1 Aug. 31, 2023

(51) Int. Cl.

*B24B 47/26* (2006.01)
*B24B 23/03* (2006.01)
*B24B 55/00* (2006.01)

(52) U.S. Cl.

CPC ..... *B24B 47/26* (2013.01); *B24B 23/03* (2013.01); *B24B 55/00* (2013.01)

(58) Field of Classification Search

CPC ..... B24B 23/026; B24B 23/03; B24B 55/00; B24B 23/028; B24B 23/02; B24B 45/006; B24B 45/00; B24B 49/16; B24B 23/00; B24B 23/04; B24B 23/043; B24B 23/046; B24B 23/06; B24B 23/08; B24B 23/005; B24B 55/05; B24B 55/052; B24B 55/055; B24B 55/057; B24B 55/10; B24B 55/102; B24B 55/105; B24B 55/107; B24B 47/26; B23Q 11/0092

USPC ..... 451/422, 344, 357; 454/359

See application file for complete search history.

(56) References Cited

U.S. PATENT DOCUMENTS 4,531,329 A * 7/1985 Huber ..... B24B 55/102 451/344
5,317,838 A * 6/1994 Bourner ..... B24B 23/03 451/357
5,595,531 A 1/1997 Niemela et al.
5,679,066 A 10/1997 Butz et al.

(Continued)

FOREIGN PATENT DOCUMENTS

CN 1990180 A 7/2007
CN 206393407 U 8/2017

(Continued)

*Primary Examiner* — Tyrone V Hall, Jr.
*Assistant Examiner* — Kent N Shum
(74) *Attorney, Agent, or Firm* — Muncy, Geissler, Olds & Lowe, P.C.

(57) ABSTRACT

A grinding machine tool comprises a housing, a driving assembly disposed in the housing, a grinding disc driven by the driving assembly, and having a grinding surface and a non-grinding surface, a switch driving the driving assembly, and a pressing plate disposed on the housing and having a first state in which the switch drives the driving assembly to drive the grinding disc when the pressing plate is operated, and a second state in which the switch stops driving the driving assembly when the pressing plate is not operated. The grinding machine tool has a grinding disc braking structure detached from the non-grinding surface when the pressing plate is in the first state; when the pressing plate is in the second state, the grinding disc braking structure moves toward the non-grinding surface and contacts with the grinding disc to stop the grinding disc from rotating.

11 Claims, 9 Drawing Sheets

(56) References Cited

U.S. PATENT DOCUMENTS

| | | | | |
|---|---|---|---|---|
| 5,813,903 | A | 9/1998 | Amano et al. | |
| 2002/0019055 | A1 | 2/2002 | Brown et al. | |
| 2019/0084115 | A1* | 3/2019 | Hafele | B24B 23/026 |
| 2020/0086455 | A1* | 3/2020 | Iwakami | B24B 47/26 |
| 2022/0331933 | A1* | 10/2022 | Naderer | B24B 47/26 |

FOREIGN PATENT DOCUMENTS

| | | | |
|---|---|---|---|
| CN | 207027181 | U | 2/2018 |
| EP | 1277544 | A | 1/2003 |
| GB | 2273900 | A | 7/1994 |
| GB | 2359266 | A | 8/2001 |
| GB | 2416726 | A | 2/2006 |

* cited by examiner

GRINDING MACHINE TOOL WITH GRINDING DISC BRAKING STRUCTURE

FIELD OF THE INVENTION

The invention relates to a grinding machine tool, more particularly to a grinding machine tool in which a brake block does not contact a grinding disc when a pressing plate is operated.

BACKGROUND OF THE INVENTION

Please refer to FIG. 1, a main structure of a conventional grinding machine tool 70 comprises a motor 71, a working shaft 72 that rotates with the motor 71, a housing 73 for providing the motor 71 and the working shaft 72 to dispose therein, a pressing plate 74 disposed on the housing 73 for determining whether the motor 71 operates or not based on an operated state of the pressing plate 74, and a grinding disc 75 disposed on the working shaft 72 and driven by the working shaft 72. When a user intends to perform grinding, the user operates the pressing plate 74 to drive the motor 71 to drive the working shaft 72, so that the grinding disc 75 rotates with the working shaft 72 for grinding. When the user wants to stop grinding, the user releases the pressing plate 74 to stop the motor 71 from driving the working shaft 72. At this time, although the grinding disc 75 stops being driven, the grinding disc 75 will continue to rotate due to an inertia of the motor 71 and the working shaft 72 and its own inertia until an inertial kinetic energy is consumed. The aforementioned phenomenon means that although the user has stopped driving the motor 71, the grinding disc 75 will continue to idle, as a result the user cannot replace consumables of the grinding machine tool 70 during this period, and also the safety of the user is easily affected.

In view of the above-mentioned problems in the prior art, the current technology has disclosed a structure of providing with a brake lining 76 in the grinding machine tool 70, such as shown in CN 1990180A, CN 206393407U, CN 207027181U, U.S. Pat. Nos. 5,595,531A, 5,679,066A, 5,813,903A, US 2002/019055A, EP 1277544A, GB 2273900A, GB 2359266A, GB 2416726A and FIG. 1. Please refer to FIG. 1 again for further illustration, the brake lining 76 is an elastic rubber ring, the brake lining 76 is disposed between the housing 73 and the grinding disc 75, the brake lining 76 is in contact with the grinding disc 75 normally and provides a resistance to the grinding disc 75 at any time. When the grinding machine tool 70 is started, because a kinetic energy output by the motor 71 is greater than the resistance exerted on the grinding disc 75, the grinding disc 75 can be rotated. When the motor 71 stops rotating, the resistance provided by the brake lining 76 is greater than an inertial force of the grinding disc 75, so that the grinding disc 75 can stop rotating. However, although the aforementioned implementation mode can achieve an effect of braking the grinding disc 75, it is easy to increase a load of the motor 71 due to the resistance provided by the brake lining 76 normally. In addition, the grinding disc 75 is also easily affected by the resistance of the brake lining 76 to cause a rotation speed to decrease, in turn reducing a grinding efficiency. Furthermore, since the brake lining 76 is in contact with the grinding disc 75 normally, the brake lining 76 wears out quickly.

SUMMARY OF THE INVENTION

A main object of the invention is to solve the problems of the conventional grinding machine tool that the brake lining keeps contacting with the grinding disc when the grinding disc is rotating.

In order to achieve the above object, the invention provides a grinding machine tool, the grinding machine tool a housing, a driving assembly disposed in the housing, a grinding disc driven by the driving assembly, a switch driving the driving assembly, and a pressing plate disposed on the housing, wherein the grinding disc comprises a grinding surface and a non-grinding surface, and when the pressing plate is operated, the pressing plate is in a first state that the switch is forced to drive the driving assembly to rotate the grinding disc, and when the pressing plate is not operated, the pressing plate in a second state that the switch is stopped to drive the driving assembly to rotate the grinding disc. Further, the grinding machine tool comprises a grinding disc braking structure, wherein when the pressing plate is in the first state, the grinding disc braking structure is detached from the non-grinding surface, and a spacing is remained between the grinding disc braking structure and the non-grinding surface, and when the pressing plate is in the second state, the grinding disc braking structure moves toward the non-grinding surface and contacts the grinding disc to stop the grinding disc from rotating.

In one embodiment, the grinding disc braking structure comprises at least one connecting rod forced by the pressing plate, and a brake block disposed on the at least one connecting rod, the brake block is provided to contact with the non-grinding surface.

In one embodiment, the at least one connecting rod comprises a first part forced by the pressing plate, and a second part provided for the brake block to be disposed thereon, the first part is formed with an assembling groove provided for the second part to dispose therein and to adjust a position of the second part.

In one embodiment, the first part is formed with an elongated hole communicating with the assembling groove, the second part is formed with at least one assembling hole, and the at least one assembling hole is assembled with a fixing member passing through the elongated hole.

In one embodiment, the housing comprises a first assembling portion, and the grinding machine tool comprises a first shaft connecting the first assembling portion with the pressing plate.

In one embodiment, a number of the at least one connecting rod is plural, the connecting rods are pivotally connected with one another, one of the connecting rods is provided for the brake block to be disposed thereon, and another one of the connecting rods is in contact with the pressing plate to force the other connecting rods.

In one embodiment, the grinding disc braking structure comprises a torsion spring disposed on the housing, the torsion spring comprises a first arm butting the housing, and a second arm butting one of the connecting rods forced by the pressing plate.

In one embodiment, the housing comprises a second assembling portion, the grinding disc braking structure comprises a second shaft disposed in the second assembling portion and assembled with the torsion spring and one of the connecting rods forced by the pressing plate, and the second shaft is a fulcrum for movement of another one of the connecting rods forced by the pressing plate.

In one embodiment, one of the connecting rods forced by the pressing plate comprises a working end which is pressed by the pressing plate, and a swinging end which is pivotally connected with another one of the connecting rods, one of the connecting rods forced by the pressing plate is assembled with the housing in a position that the working end is higher than the swinging end.

In one embodiment, one of the connecting rods forced by the pressing plate comprises a rod body disposed on the housing, and an extension arm extending from one side of the rod body for the torsion spring to be disposed thereon, and the second arm of the torsion spring abuts the extension arm.

In one embodiment, the housing comprises a set of gas passages, and a mounting hole provided for at least one of the connecting rods to dispose therein, the mounting hole is not communicated with the set of gas passages, and one port of the mounting hole is located within a projection area of the pressing plate.

In one embodiment, the switch is disposed offsetly from a center line of the pressing plate.ss Accordingly, compared with the prior art, the invention has the following features: through disposition of the grinding disc braking structure in the invention, the grinding disc is capable of rotating without being affected by a resistance of the grinding disc braking structure, and at the same time the grinding disc braking structure is also capable of providing braking for the grinding disc when the grinding disc is intended to stop rotating.

DETAILED DESCRIPTION OF THE PREFERRED EMBODIMENTS

Figure 1:
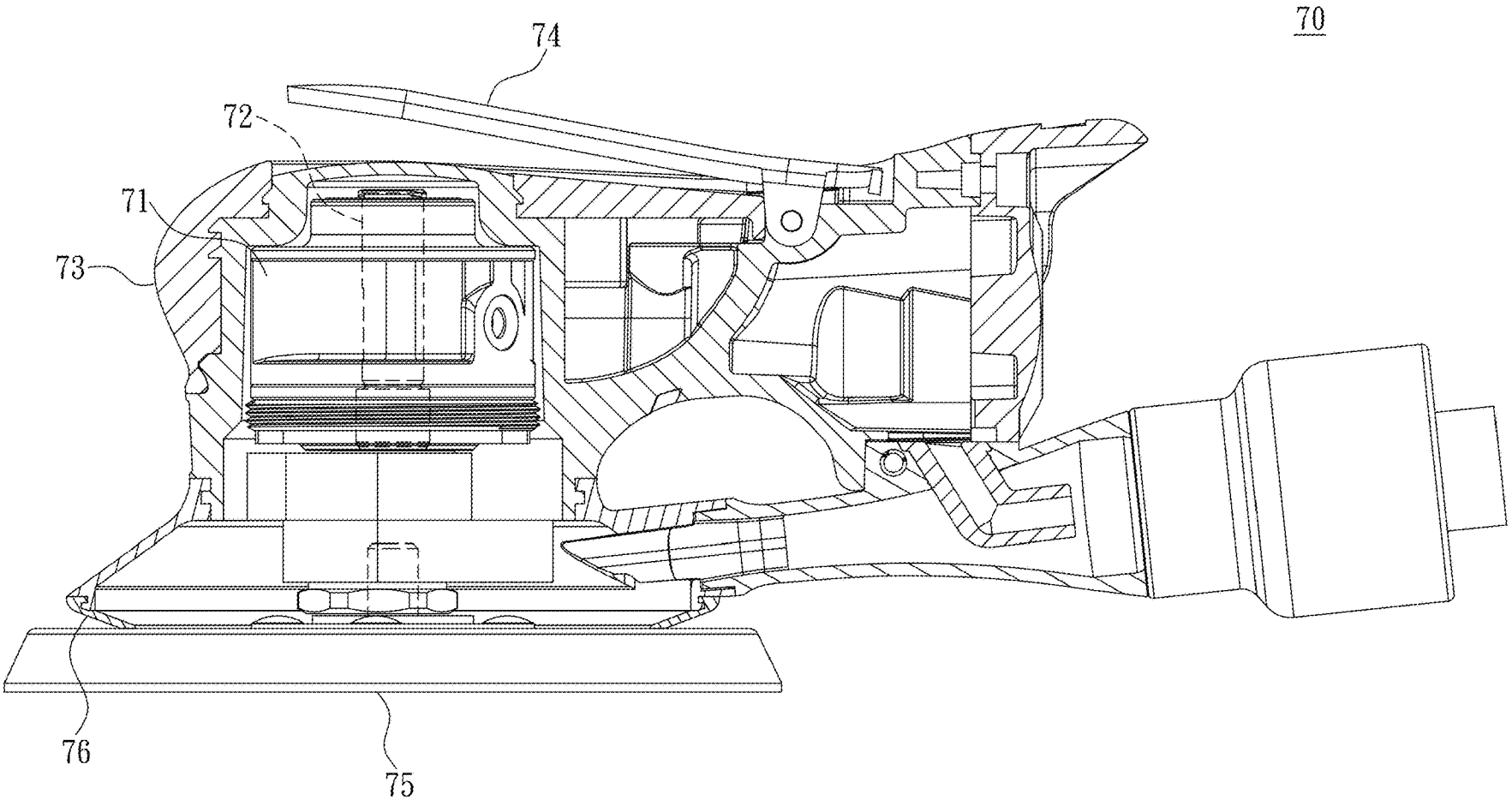
Fig. 1 PRIOR ART
FIG. 1 is a schematic diagram of a conventional grinding machine tool with a brake lining.
Figure 2:
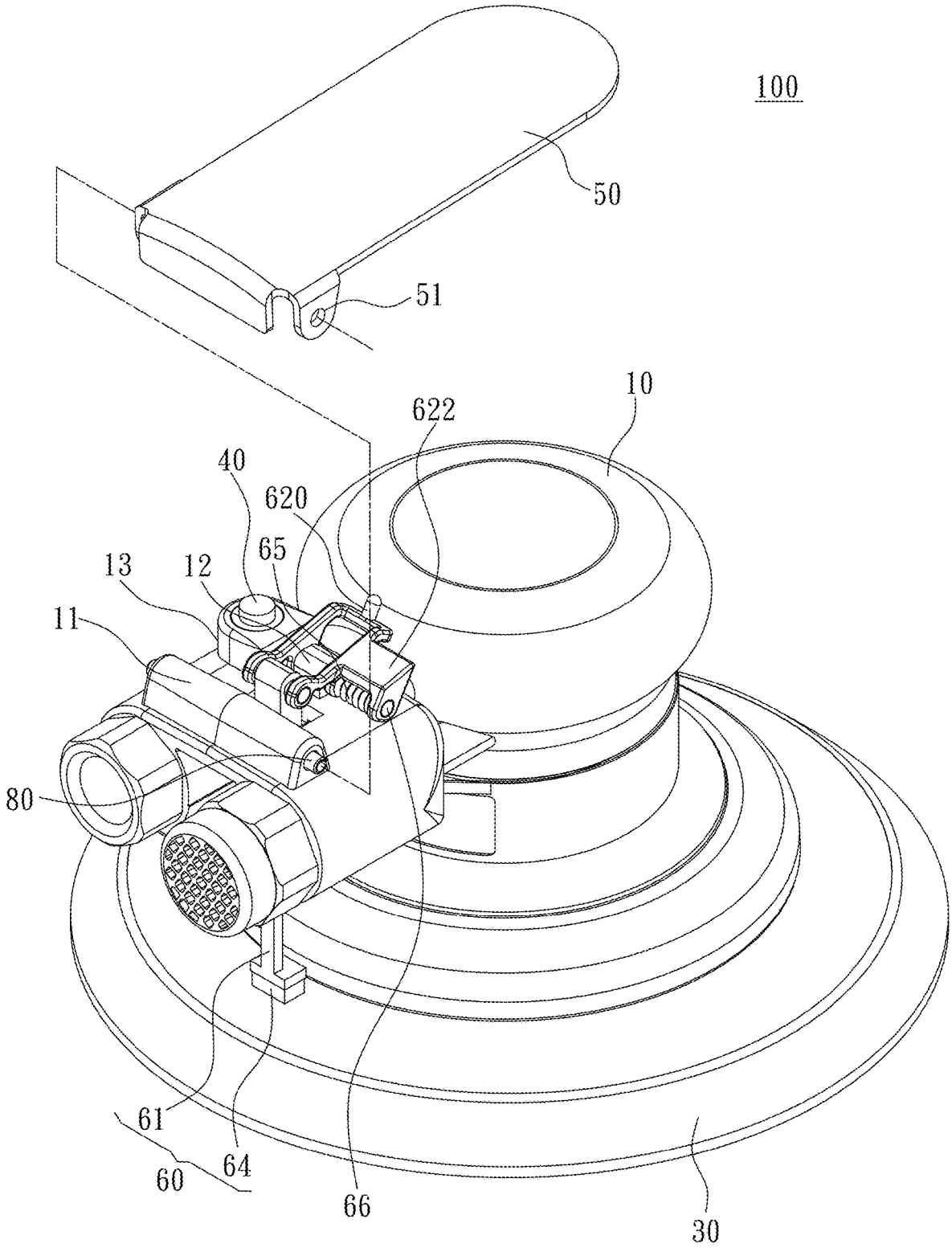
FIG. 2 is a perspective view of one embodiment of the invention.
Figure 3:
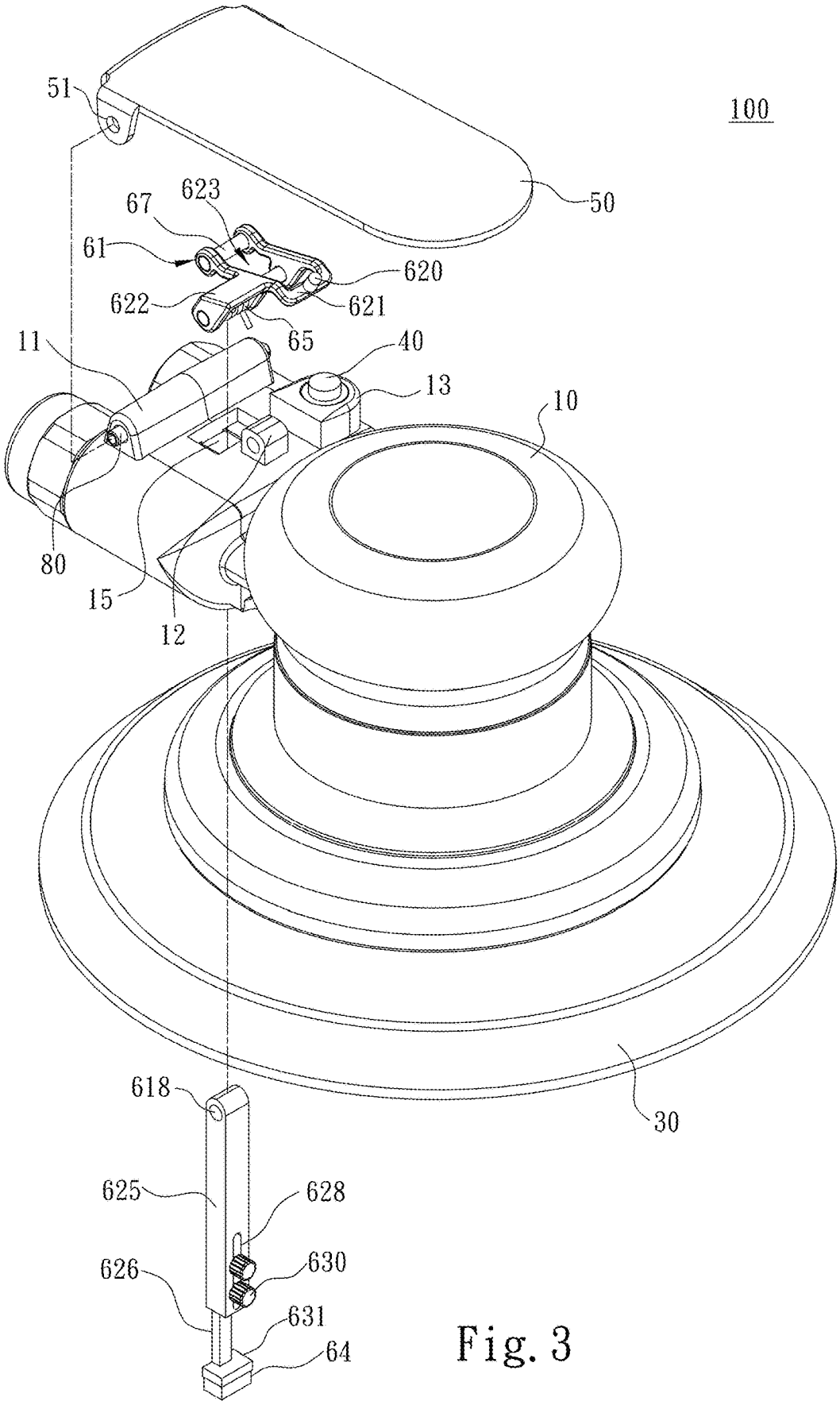
FIG. 3 is a perspective view of an exploded structure of one embodiment of the invention.
Figure 4:
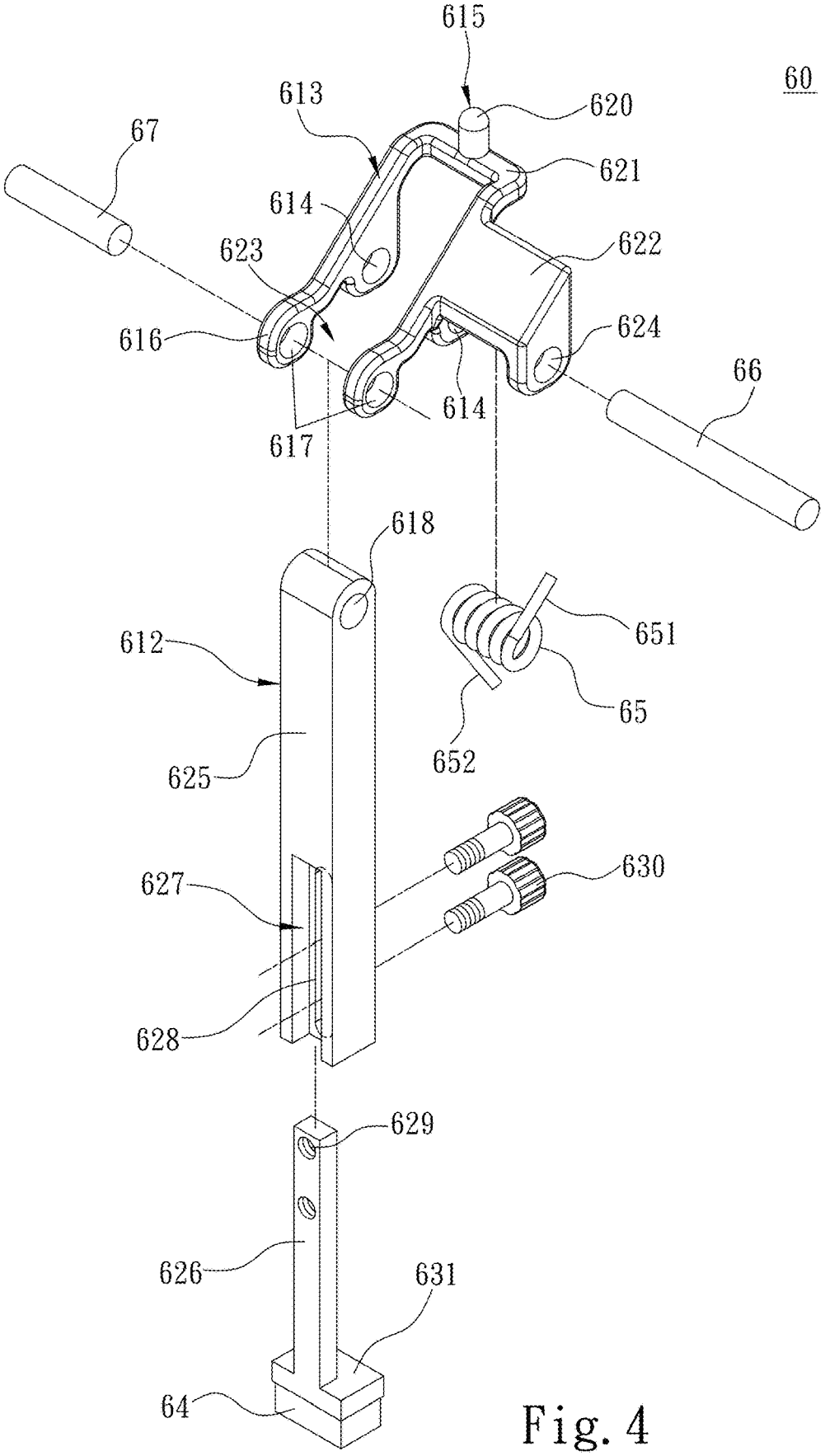
FIG. 4 is a perspective view of an exploded partial structure of one embodiment of the invention.

The detailed description and technical content of the invention are described below with reference to the accompanying drawings.

Please refer to FIG. 2, FIG. 3, FIG. 4, FIG. 5 and FIG. 6, the invention provides a grinding machine tool 100, the grinding machine tool 100 includes a housing 10, a driving assembly 20, a grinding disc 30, a switch 40 and a pressing plate 50. Specifically, the driving assembly 20 is disposed in the housing 10, the driving assembly 20 comprises a motor 21 and a working shaft 22, and the motor 21 is not limited to an electric type or a pneumatic type. The motor 21 outputs power after being started, the working shaft 22 is connected to the motor 21 and driven by the motor 21. The grinding disc 30 is connected to the working shaft 22, and the grinding disc 30 rotates with the working shaft 22 to grind an object. The switch 40 is used to determine on and off of the driving assembly 20. The switch 40 drives the driving assembly 20 to work after being operated, and stops driving the driving assembly 20 after being operated again. The pressing plate 50 is disposed on the housing 10 and capable of being operated. The pressing plate 50 determines whether to drive the driving assembly 20 or not according to an operated state of the pressing plate 50. In detail, the pressing plate has a first state when the pressing plate 50 is operated, and a second state when the pressing plate 50 is not operated. When the pressing plate 50 is in the first state, the switch 40 is acted to drive the driving assembly 20, so that the driving assembly 20 drives the grinding disc 30 to rotate. When the pressing plate 50 is in the second state, the switch 40 is no longer acted and stops driving the driving assembly 20, so that the driving assembly 20 stops driving the grinding disc 30.

When the switch 40 stops driving the driving assembly 20, the grinding disc 30 no longer receives a kinetic energy output by the driving assembly 20, but the grinding disc 30 will continue to rotate subject to an inertia effect of the driving assembly 20 and the grinding disc 30 itself. In this regard, in order to prevent the grinding disc 30 from idling, the grinding machine tool 100 of the invention is provided with a grinding disc braking structure 60 which is forced by the pressing plate 50 when the pressing plate 50 is operated to provide braking for the grinding disc 30. In detail, please together refer to FIG. 7, the grinding disc 30 has a grinding surface 31 and a non-grinding surface 32. The grinding surface 31 is disposed on a side of the grinding disc 30 facing the object, and the grinding surface 31 is used for grinding the object to be ground. The non-grinding surface 32 can be a surface disposed on another side of the grinding disc 30 facing the housing 10, or be disposed on an inclined side of the grinding disc 30 connected with the surface mentioned above, and the non-grinding surface 32 is not used for grinding. When the grinding disc braking structure 60 contacts the non-grinding surface 32 (the surface or the inclined side of the grinding disc 30), the grinding disc braking structure 60 produces a resistance for the grinding disc 30 to stop the grinding disc 30 from rotating.

Figure 7:
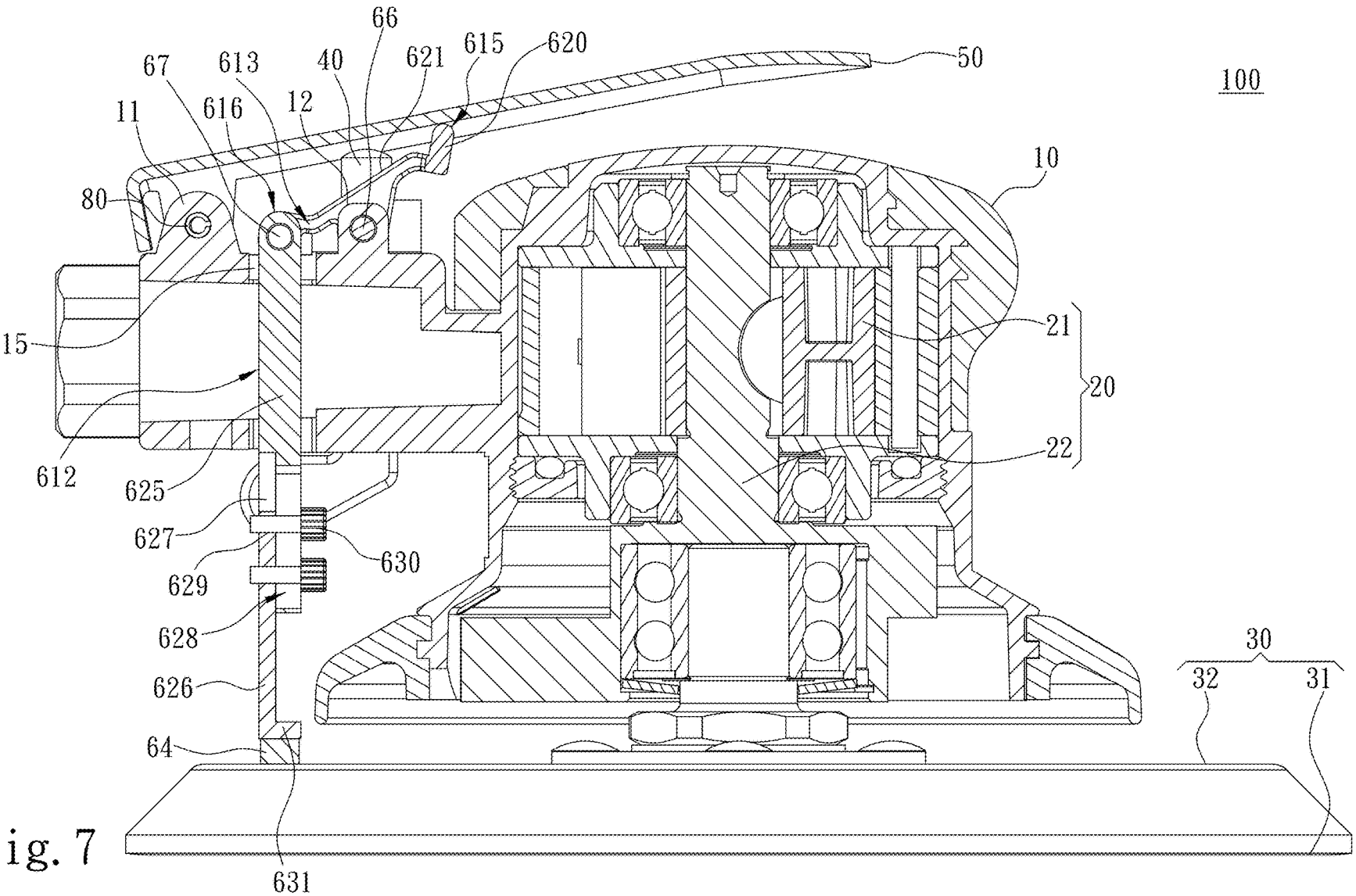
FIG. 7 is a cross-sectional structural view of one embodiment of the invention from another direction.
Figure 8:
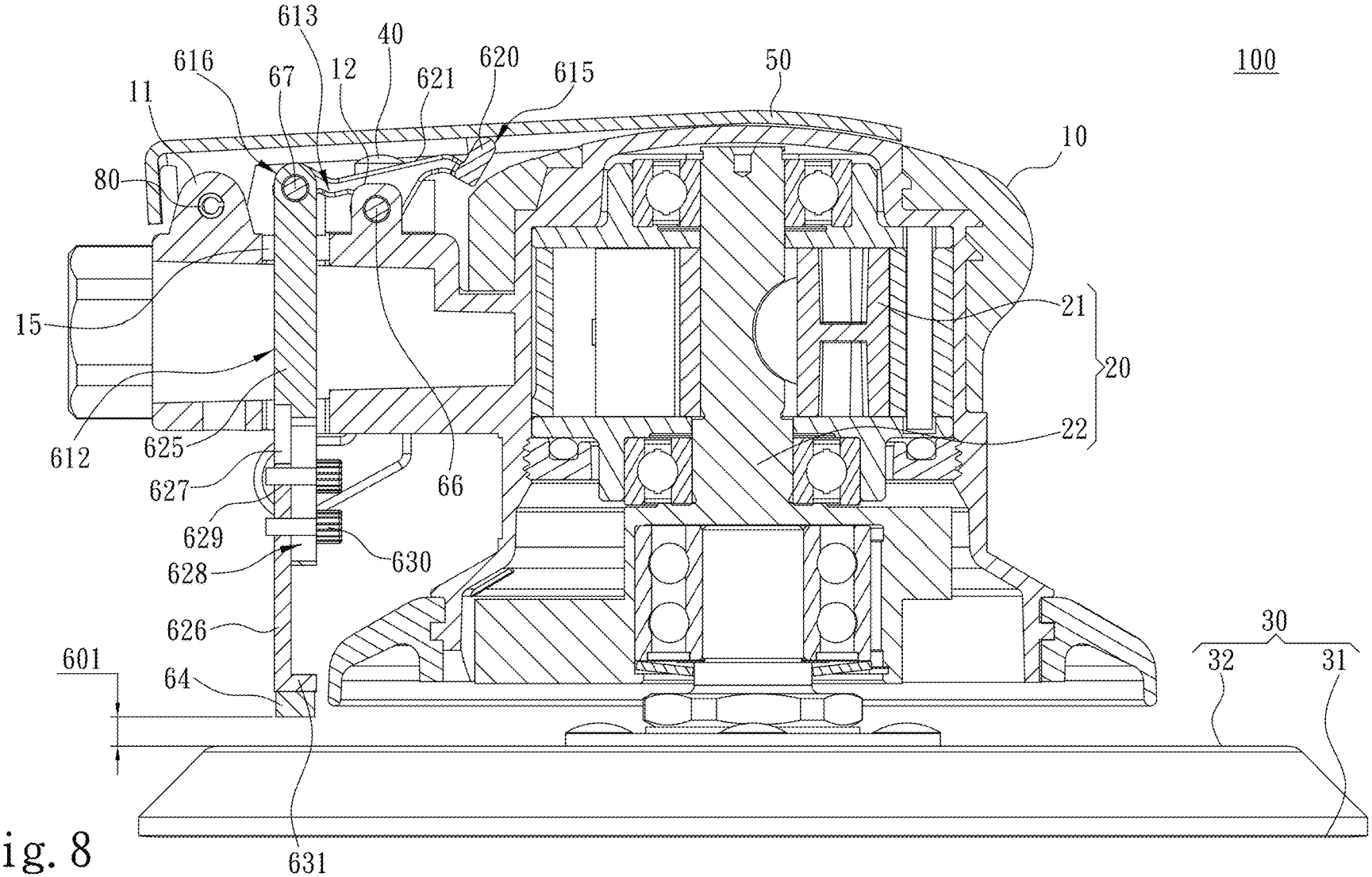
FIG. 8 is a cross-sectional structural view of an implementation state of one embodiment of the invention.

For a more detailed explanation of implementation of the grinding machine tool 100, please refer to FIG. 7 and FIG. 8. Assuming initially that the pressing plate 50 is not operated, the pressing plate 50 is in the second state and the grinding disc 30 is not driven. At this time, the grinding disc 30 is in contact with the grinding disc braking structure 60 and is completely stationary, as shown in FIG. 7. When the pressing plate 50 is operated, the pressing plate 50 turns into the first state, and the switch 40 is acted to drive the driving assembly 20 so that the grinding disc 30 starts to rotate. At the same time, the grinding disc braking structure 60 is forced by the pressing plate 50 to move away from the non-grinding surface 32 of the non-grinding surface 32, so that the grinding disc braking structure 60 is detached from the non-grinding surface 32, and a spacing 601 is maintained between the grinding disc braking structure 60 and the non-grinding surface 32. The grinding disc 30 is capable of rotating without the resistance of the grinding disc braking structure 60, as shown in FIG. 8. When the pressing plate 50 is no longer operated, the pressing plate 50 then turns into the second state. The switch 40 stops driving the driving assembly 20 so that the grinding disc 30 is no longer driven. At this time, the grinding disc braking structure 60 moves toward the non-grinding surface 32 and contacts the grinding disc 30, so that the grinding disc 30 is braked by the grinding disc braking structure 60, and then stops rotating.

Please refer to FIG. 1 and FIG. 2 again. It can be known from the above that in order for the invention to solve the problem that the conventional grinding disc 75 idles when the conventional grinding disc 75 stops being driven, the grinding disc braking structure 60 is provided on the grinding machine tool 100, so that the grinding disc 30 can be braked by the grinding disc braking structure 60 when the grinding disc 30 stops being driven, and rotation of the grinding disc 30 can be stopped quickly. In addition, the grinding disc braking structure 60 of the invention provides braking only when the grinding disc 30 is not driven. When the grinding disc 30 is driven, the grinding disc braking structure 60 does not contact the grinding disc 30, and the grinding disc braking structure 60 does not produce resistance force on the grinding disc 30 when the grinding disc 30 is rotating, thereby reducing a loss of kinetic energy output by the driving assembly 20, and further improving the problem that the conventional brake lining 76 wears out quickly due to the conventional brake lining 76 rubbing the grinding disc 75 over a long period of time.

Please refer to FIG. 2, FIG. 3, FIG. 4 and FIG. 7. In one embodiment, the grinding disc braking structure 60 comprises at least one connecting rod 61 and a brake block 64 disposed on the connecting rod 61. The least one connecting rod 61 faces the pressing plate 50, and the brake block 64 is disposed on the connecting rod 61 and is moved along with the connecting rod 61. When the pressing plate 50 turns into the second state, the least one connecting rod 61 is forced by the pressing plate 50 so that the brake block 64 is in contact with the non-grinding surface 32.

Further, the housing 10 is formed with a first assembling portion 11; the pressing plate 50 is formed with at least one hole 51; and the grinding machine tool 100 includes a first shaft 80, wherein the at least one hole 51 is disposed corresponding to the first assembling portion 11, and the first shaft 80 is disposed in the first assembling portion 11 and the at least one hole 51. When the pressing plate 50 is operated to turn into the first state from the second state, the pressing plate 50 is capable of displacing toward the housing 10 through the first shaft 80. The least one connecting rod 61 and the switch 40 are located on a displacement path of the pressing plate 50, so that the pressing plate 50 presses the least one connecting rod 61 and the switch 40 when the pressing plate 50 turns into the first state.

Please refer to FIG. 2, FIG. 3, FIG. 4, and FIG. 7. In one embodiment, the number of the at least one connecting rod 61 is plural, and the connecting rods 61 are pivotally connected with one another, one of the connecting rods 61 is provided for disposing the brake block 64, and another one of the connecting rods 61 is forced by the pressing plate 50. In addition, for the convenience of description hereinafter, one of the connecting rods 61 provided with the brake block 64 is defined as a first connecting rod 612, another one of the connecting rods 61 forced by the pressing plate 50 is defined as a second connecting rod 613. In one embodiment, the second connecting rod 613 is pivotally connected with the first connecting rod 612 directly. In another embodiment, other connecting rods 61 are assembled between the second connecting rod 613 and the first connecting rod 612. The first connecting rod 612 is forced by the second connecting rod 613 after the second connecting rod 613 is forced by the pressing plate 50.

Further, the grinding disc braking structure 60 comprises a torsion spring 65. The torsion spring 65 is disposed on the housing 10 and is in contact with the second connecting rod 613. The torsion spring 65 includes a first arm 651 and a second arm 652, the first arm 651 butts against the housing 10, the second arm 652 butts against the second connecting rod 613. When the second connecting rod 613 is forced by the pressing plate 50, the torsion spring 65 is pressed by the second connecting rod 613 from the second arm 652, and so that an elastic potential energy is stored in the torsion spring 65. When the second connecting rod 613 is no longer forced by the pressing plate 50, the elastic acting force is released, and the torsion spring 65 pushes the second connecting rod 613 via the second arm 652 to reset the second connecting rod 613.

The housing 10 comprises a second assembling portion 12; the second connecting rod 613 comprises at least one opening 614 corresponding to the second assembling portion 12; the grinding disc braking structure 60 comprises a second shaft 66. The second shaft 66 is assembled with the torsion spring 65 and is disposed in the second assembling portion 12 and the opening 614. The second shaft 66 is provided as a fulcrum for movement of the second connecting rod 613, and the fulcrum enables two ends of the second connecting rod 613 to swing relative to the housing 10 when the second connecting rod 613 are forced by the pressing plate 50 or are pushed against by the torsion spring 65. In addition, one of the two ends of the second connecting rod 613 is a working end 615, and another end of the second connecting rod 613 is a swinging end 616. The working end 615 is forced by the pressing plate 50, and the swinging end 616 is directly or indirectly connected to the first connecting rod 612. Since the swinging end 616 is affected by a gravitational effect of the first connecting rod 612, the second connecting rod 613 is assembled with the housing 10 in an inclined manner, that is to say, the second connecting rod 613 is assembled with the housing 10 in a position that a horizontal height of the working end 615 is greater than a horizontal height of the swinging end 616. In one embodiment, when the second connecting rod 613 is directly pivotally connected to the first connecting rod 612, the swinging end 616 is formed with at least one through hole 617, and the first connecting rod 612 is formed with at least one perforation 618 aligning with the at least one through hole 617. The grinding disc braking structure 60 includes a third shaft 67 disposed in the at least one through hole 617 and the at least one perforation 618, so that the swinging end 616 is pivotally connected to the first connecting rod 612 through the third shaft 67. When the working end 615 is pressed by the pressing plate 50, the swinging end 616 lifts the first connecting rod 612 based on lever action. Further, in another embodiment, the second connecting rod 613 is formed with an auxiliary working block 620 extending from the working end 615 toward the pressing plate 50, wherein an extension direction of the auxiliary working block 620 is different from an inclined direction of the second connecting rod 613, thereby assisting the pressing plate 50 to press the working end 615.

Figure 5:
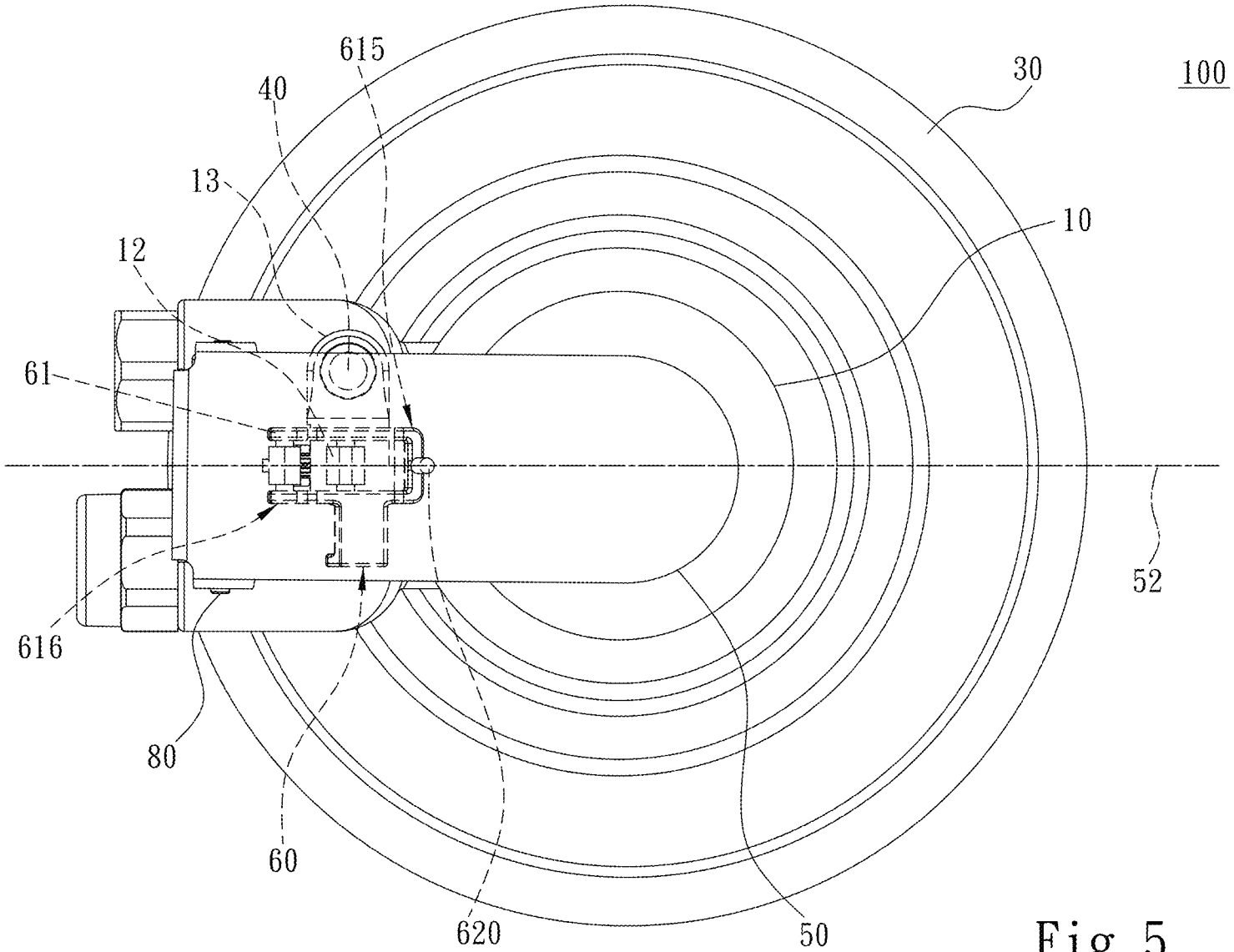
FIG. 5 is a top view of one embodiment of the invention.
Figure 6:
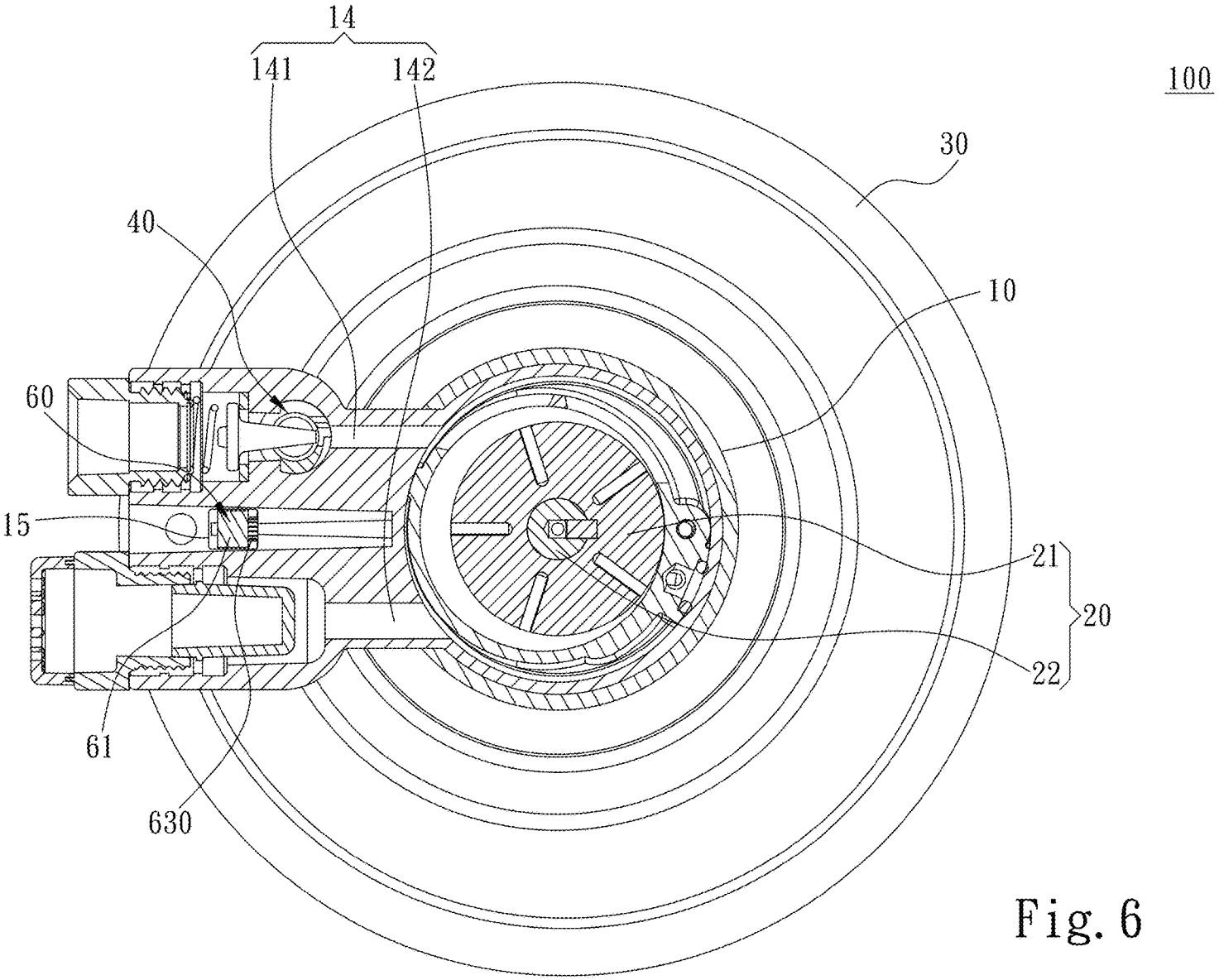
FIG. 6 is a cross-sectional structural view of one embodiment of the invention.

Please refer to FIG. 4, FIG. 5, FIG. 6 and FIG. 7. In one embodiment, the housing 10 is formed with an assembly boss 13 facing the pressing plate 50, and the assembly boss 13 is provided for the switch 40 to be disposed thereon. The assembly boss 13 is adjacent to the working end 615 and does not interfere with movement of the second connecting rod 613. In detail, a center line 52 is defined on the pressing plate 50 as shown in FIG. 5, the working end 615 is located on the center line 52, and the assembly boss 13 is located on one side of the working end 615, so that the switch 40 is disposed offsetly from the center line 52. It should be noted that a disposing range of the switch 40 must be within an area where the pressing plate 50 is capable of contacting the switch 40 simultaneously when the pressing plate 50 presses the working end 615, so that the pressing plate 50 is capable of forcing the working end 615 and forcing the switch 40 at the same time.

Further, the second connecting rod 613 comprises a rod body 621 and an extension arm 622. The rod body 621 is provided with the working end 615 and the swinging end 616, and the rod body 621 is disposed on the housing 10. The rod body 621 is formed with a hollow area 623 which prevents the second connecting rod 613 from interfering with the second assembling portion 12 when the second connecting rod 613 swings. The extension arm 622 extends from one side of the rod body 621, and the extension arm 622 provides the second arm 652 of the torsion spring 65 to butt thereon. In one embodiment, the extension arm 622 is formed with an assembly opening 624, the assembly opening 624 and the opening 614 are located on a same extension line, and the opening 614 is provided for the second shaft 66 to insert therein.

On the other hand, please refer to FIG. 3, FIG. 4, FIG. 5 and FIG. 6, in one embodiment that the grinding machine tool 100 of the invention is a pneumatic machine tool, the housing 10 comprises a set of gas passages 14 and a mounting hole 15. The set of gas passages 14 comprises an air inlet passage 141 and an air outlet passage 142, the air inlet passage 141 is controlled by the switch 40 to determine whether to allow the air to enter and drive the driving assembly 20, and the air outlet passage 142 communicates with the air inlet passage 141 and is provided for discharging gas. The mounting hole 15 is provided for at least one of the connecting rods 61 to dispose therein, and the mounting hole 15 does not communicate with the set of gas passages 14. In one embodiment, the mounting hole 15 is integrally formed with the housing 10; in another embodiment, the mounting hole 15 is formed by communicating two ports respectively provided on the housing 10, and one of the two ports of the mounting hole 15 is located within a projection area of the pressing plate 50.

Figure 9:
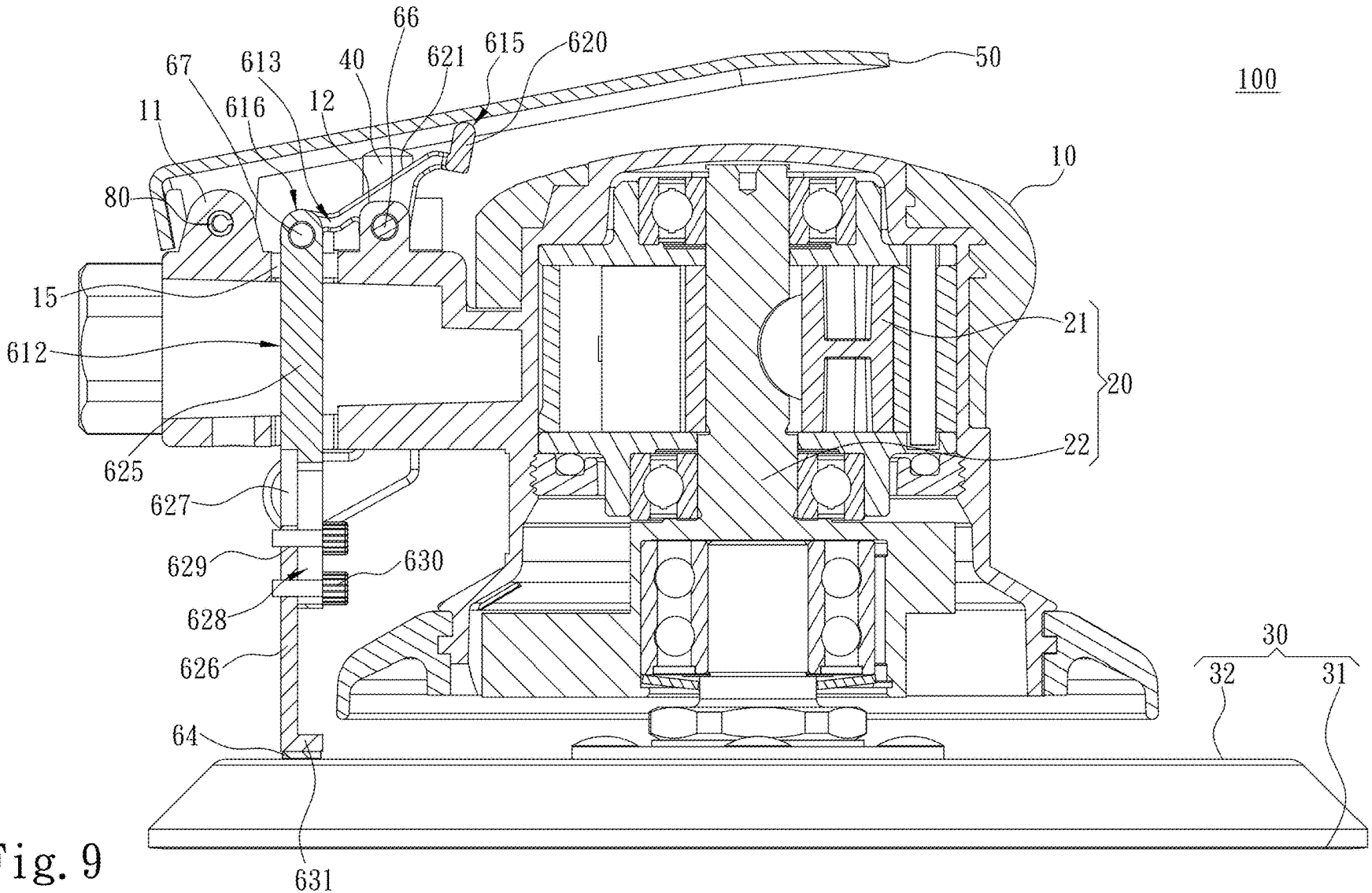
FIG. 9 is a cross-sectional structural view of adjustment of connecting rods of one embodiment of the invention.

Please refer to FIG. 7, FIG. 8 and FIG. 9. In order to adjust a height of the brake block 64 relative to the grinding disc 30, the connecting rod 61 of the invention comprises a first part 625 and a second part 626, wherein the second part 626 is provided for disposal of the brake block 64. In the embodiment that the grinding disc braking structure 60 is provided with a single connecting rod 61, the first part 625 is directly forced by the pressing plate 50. In another embodiment that the grinding disc braking structure 60 is provided with a plurality of connecting rods 61, the first part 625 is directly or indirectly connected to the second connecting rod 613, and the second connecting rod 613 is forced by the pressing plate 50. In addition, the first part 625 is formed with an assembling groove 627, which is provided for the second part 626 to dispose therein and to adjust position. The assembling groove 627 restricts the second part 626 to be only capable of linearly displacing relative to the first part 625. In addition, the first part 625 is formed with an elongated hole 628, which communicates with the assembling groove 627. The second part 626 is formed with at least one assembling hole 629, the first connecting rod 612 comprises at least one fixing member 630, and the fixing member 630 is assembled with the assembling hole 629 after passing through the elongated hole 628, so that an assembly position of the second part 626 can be fixed. Meanwhile, the invention limits a displacement range of the second part 626 relative to the first part 625 through disposition of the elongated hole 628. In yet another embodiment, the first connecting rod 612 has a mounting seat 631 disposed on the second part 626, a size of the mounting seat 631 is larger than a size of the second part 626, and the mounting seat 631 is provided for the brake block 64 to dispose thereon.

What is claimed is:

1. A grinding machine tool, comprising a housing, a driving assembly disposed in the housing, a grinding disc driven by the driving assembly, a switch driving the driving assembly, and a pressing plate disposed on the housing, wherein the grinding disc comprises a grinding surface and a non-grinding surface, and when the pressing plate is operated, the pressing plate is in a first state that forces the switch to drive the driving assembly to rotate the grinding disc, and when the pressing plate is not operated, the pressing plate is in a second state that causes the switch to stop driving the driving assembly to rotate the grinding disc, the grinding machine tool is characterized in that:

the grinding machine tool comprises a grinding disc braking structure, wherein when the pressing plate is in the first state, the grinding disc braking structure is detached from the non-grinding surface, and causing a spacing between the grinding disc braking structure and the non-grinding surface, and when the pressing plate is in the second state, the grinding disc braking structure moves toward the non-grinding surface and contacts the grinding disc to stop the grinding disc from rotating, the grinding disc braking structure comprises at least one connecting rod connected with and pushed by the pressing plate, and a brake block disposed on the at least one connecting rod, the brake block is provided to contact the non-grinding surface.

2. The grinding machine tool as claimed in claim 1, wherein the at least one connecting rod comprises a first part connected with and pushed by the pressing plate, and a second part provided for the brake block to be disposed thereon, the first part is formed with an assembling groove provided for the second part to dispose therein and to adjust a position of the second part.

3. The grinding machine tool as claimed in claim 2, wherein the first part is formed with an elongated hole communicating with the assembling groove, the second part is formed with at least one assembling hole, and the at least one assembling hole is assembled with a fixing member passing through the elongated hole.

4. The grinding machine tool as claimed in claim 3, wherein the housing comprises a first assembling portion, and the grinding machine tool comprises a first shaft connecting the first assembling portion with the pressing plate.

5. The grinding machine tool as claimed in claim 4, wherein a number of the at least one connecting rod is plural, each of the connecting rods is pivotally connected with another connecting rod, and the connecting rods comprise a first rod provided for the brake block to be disposed thereon, and a second rod in contact with the pressing plate to push the other connecting rods.

6. The grinding machine tool as claimed in claim 5, wherein the grinding disc braking structure comprises a torsion spring disposed on the housing, the torsion spring comprises a first arm butting the housing, and a second arm butting the second rod of the connecting rods connected with and pushed by the pressing plate.

7. The grinding machine tool as claimed in claim 6, wherein the housing comprises a second assembling portion, the grinding disc braking structure comprises a second shaft disposed in the second assembling portion and assembled with the torsion spring and the second rod of the connecting rods connected with and pushed by the pressing plate, and the second shaft is a fulcrum for movement of the second rod of the connecting rods connected with and pushed by the pressing plate.

8. The grinding machine tool as claimed in claim 7, wherein one of the connecting rods connected with and pushed by the pressing plate comprises a working end which is pressed by the pressing plate, and a swinging end which is pivotally connected with another the second rod of the connecting rods, the second rod of the connecting rods connected with and pushed by the pressing plate is assembled with the housing in a position that the working end is higher than the swinging end.

9. The grinding machine tool as claimed in claim 8, wherein the second rod of the connecting rods connected with and pushed by the pressing plate comprises a rod body disposed on the housing, and an extension arm extending from one side of the rod body for the torsion spring to be disposed thereon, and the second arm of the torsion spring abuts the extension arm.

10. The grinding machine tool as claimed in claim 4, wherein the housing comprises a set of gas passages, and a mounting hole provided for at least one of the connecting rods to dispose therein, the mounting hole is not communicated with the set of gas passages, and one port of the mounting hole is located within a projection area of the pressing plate.

11. The grinding machine tool as claimed in claim 10, wherein the switch is offset from a center line of the pressing plate.

* * * * *